US011885049B2

(12) United States Patent
Tatsuno et al.

(10) Patent No.: US 11,885,049 B2
(45) Date of Patent: Jan. 30, 2024

(54) MESH BELT USED IN APPARATUS FOR PRODUCING WATER ABSORBING BODY

(71) Applicant: NIPPON FILCON CO., LTD., Tokyo (JP)

(72) Inventors: Takehiko Tatsuno, Tokyo (JP); Masahiro Yoshikawa, Tokyo (JP); Teppei Hashiguchi, Tokyo (JP); Shinsuke Ueno, Tokyo (JP)

(73) Assignee: NIPPON FILCON CO., LTD., Tokyo (JP)

( * ) Notice: Subject to any disclaimer, the term of this patent is extended or adjusted under 35 U.S.C. 154(b) by 610 days.

(21) Appl. No.: 16/851,762

(22) Filed: Apr. 17, 2020

(65) Prior Publication Data

US 2020/0263332 A1 Aug. 20, 2020

Related U.S. Application Data

(63) Continuation of application No. PCT/JP2018/035566, filed on Sep. 26, 2018.

(30) Foreign Application Priority Data

Oct. 19, 2017 (JP) ..... 2017-202271

(51) Int. Cl.
*D21F 7/12* (2006.01)
*D03D 1/00* (2006.01)
(Continued)

(52) U.S. Cl.
CPC ..... *D03D 1/0094* (2013.01); *D03D 9/00* (2013.01); *D03D 15/00* (2013.01); *D03D 15/25* (2021.01);
(Continued)

(58) Field of Classification Search
CPC ..... D03D 1/0094; D03D 9/00; D03D 15/00; D03D 15/25; D03D 15/275; D03D 15/283;
(Continued)

(56) References Cited

U.S. PATENT DOCUMENTS 3,238,594 A * 3/1966 Schuster ..... D21F 1/16 28/165
4,420,529 A * 12/1983 Westhead ..... D03D 15/533 428/389
(Continued)

FOREIGN PATENT DOCUMENTS

DE 199 09 031 A1 9/2000
GB 991655 A 5/1965
(Continued)

OTHER PUBLICATIONS

Office Action issued in Japanese Application No. 2017-202271, dated Mar. 9, 2021.
(Continued)

*Primary Examiner* — Robert H Muromoto, Jr.
(74) *Attorney, Agent, or Firm* — Michael Best & Friedrich LLP

(57) ABSTRACT

A mesh belt used in a process for producing a water absorbing body which is formed by warps and wefts being woven with each other. One or more yarns which constitute (s) the warps or the wefts emerging on at least a transporting surface side of the mesh belt is made of an electrically conductive material.

12 Claims, 1 Drawing Sheet

(51) Int. Cl.

| | |
|---|---|
| ***D03D 9/00*** | (2006.01) |
| ***D03D 15/00*** | (2021.01) |
| ***D21F 7/08*** | (2006.01) |
| ***D21H 17/20*** | (2006.01) |
| ***D21H 21/22*** | (2006.01) |
| ***D21H 27/00*** | (2006.01) |
| ***D03D 15/275*** | (2021.01) |
| ***D03D 15/25*** | (2021.01) |
| ***D03D 15/283*** | (2021.01) |
| ***D21F 1/00*** | (2006.01) |
| ***D03D 15/533*** | (2021.01) |

(52) U.S. Cl.
CPC ..... *D03D 15/275* (2021.01); *D03D 15/283* (2021.01); *D03D 15/533* (2021.01); *D21F 1/0027* (2013.01); *D21F 7/08* (2013.01); *D21H 17/20* (2013.01); *D21H 21/22* (2013.01); *D21H 27/002* (2013.01); *D10B 2321/022* (2013.01); *D10B 2401/02* (2013.01)

(58) Field of Classification Search
CPC ..... D03D 15/533; D03D 1/00; D21F 1/0027; D21F 7/08; D21H 17/20; D21H 21/22; D21H 27/002; D10B 2321/022; D10B 2401/02; D10B 2331/021; D10B 2401/16
See application file for complete search history.

(56) References Cited

U.S. PATENT DOCUMENTS

| | | | | |
|---|---|---|---|---|
| 6,194,332 | B1 * | 2/2001 | Rock | D04B 1/16 442/317 |
| 7,029,555 | B2 * | 4/2006 | Yamanaka | D21F 1/60 210/402 |
| 7,481,250 | B2 * | 1/2009 | Ito | D03D 11/00 139/408 |
| 8,513,147 | B2 * | 8/2013 | Gupta | D04H 1/4383 442/337 |
| 2006/0046593 | A1 * | 3/2006 | Senellart | F16G 1/00 442/224 |
| 2008/0087527 | A1 * | 4/2008 | Esser | B65G 15/54 198/844.1 |
| 2011/0121481 | A1 * | 5/2011 | Monnerie | D04H 3/16 425/72.2 |

FOREIGN PATENT DOCUMENTS

| | | | |
|---|---|---|---|
| JP | S56-021876 | B1 | 5/1981 |
| JP | S62-250252 | A | 10/1987 |
| JP | 2799728 | B | 9/1998 |
| JP | 2799729 | B | 9/1998 |
| JP | 2896899 | B | 5/1999 |
| JP | 2002-309473 | A | 10/2002 |
| JP | 2003-096684 | A | 4/2003 |
| JP | 2005-163230 | A | 6/2005 |
| JP | 2005-163230 | A | 6/2005 |
| JP | 2008-511766 | A | 4/2008 |
| JP | 4257291-8 | | 2/2009 |
| JP | 2014-091869 | A | 5/2014 |
| JP | 2017-020157 | A | 1/2017 |

OTHER PUBLICATIONS

International Search Report issued in Application No. PCT/JP2018/035566, dated Dec. 4, 2018.
Office Action issued in Japanese Application No. 2017-202271, dated Aug. 17, 2021.
Extended Search Report issued in European Application No. 18867572.2, dated Jun. 9, 2021.
Article 94(3) EPC Communication issued in European Application No. 18867572.2 dated Sep. 19, 2023.

* cited by examiner

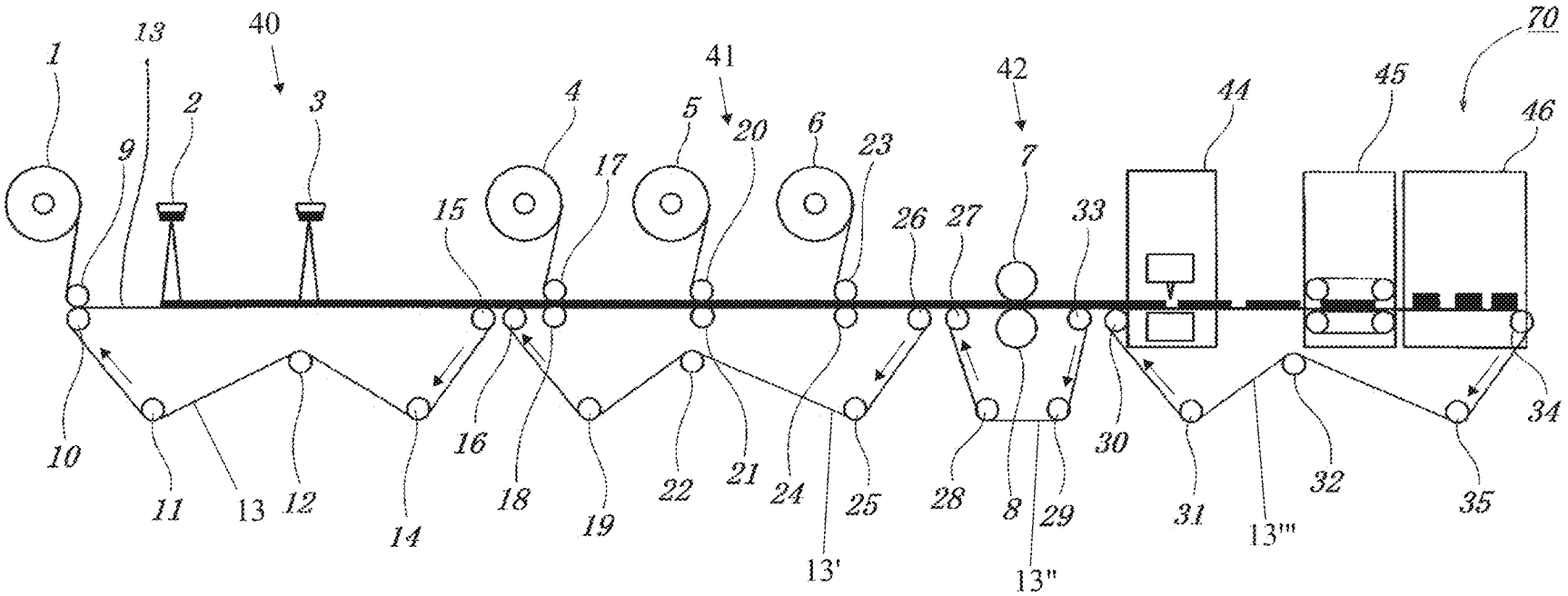
70
46
45
44
42
41
40
1
2
3
4
5
6
7
8
9
10
11
12
13
13'
13''
13'''
14
15
16
17
18
19
20
21
22
23
24
25
26
27
28
29
30
31
32
33
34
35

MESH BELT USED IN APPARATUS FOR PRODUCING WATER ABSORBING BODY

RELATED APPLICATIONS

This is a continuation of PCT/JP2018/035566 filed on Sep. 26, 2018, claiming the priority based on Japanese Patent Application No. 2017-202271 filed on Oct. 19, 2017, the contents of these applications of which, including the specifications, the claims and the drawings, are incorporated herein by reference in their entirety.

TECHNICAL FIELD OF THE INVENTION

The present invention relates to a mesh belt which eliminates troubles in a line for producing a water absorbing body, whereby a producing line of the mesh belt used in an apparatus for producing a water absorbing body can be prolonged. In particular, the present invention relates to a technique for restricting a meander and a turning up of the mesh belt which restrains the scattering of powder material upon the operation of the producing line to prevent the scattered material powers from being stuck on a transfer roll, etc.

BACKGROUND ART

Nowadays, various kinds of products a part of which contains the water absorbing body have been supplied. The water absorbing body is a sanitary goods in which a water absorbing property is required. For instance, a paper diaper, a paper diaper for animals, a training pad, a sanitary napkin, a sweat pad, an incontinence pad, a support sleep sheet, a care support sheet, etc. are enumerated as examples.

In a process fir producing the paper diapers containing a water absorbing body, for instance, a back sheet is fed from a web roll to be transported on mesh belt, and short fibers which is a material for the water absorbing body are rested on such a back sheet. Thereafter, tissues, gathers or top sheets fed from the web roll are fed on a no-woven fabric to be cut into a desired size by means of a side cutter, an end cutter, as needed, whereby the water absorbing body is produced as a final product via a bending device. Japanese Patent Laid-open Publication No. 2017-020157, for instance, discloses such a structure of the water absorbing body, and the method of producing the water absorbing body.

Such a mesh belt has been known to have a short produce life. The present inventor found out causes for the short product life, that is, the meandering of the mesh belt in the conveyor on the apparatus for producing the water absorbing body. The applicant took measures to adjust the meandering of the mesh belt by providing a guide roll on the mesh belt, for instance, but it did not turn out to be sweeping countermeasures, Such being the case, the present inventor paid attention to the power material stuck on the transfer roll in order to identify the causes for the meandering of the mesh belt on the conveyor. It was found out that the generation of such a power material causes the mesh belt to slide, or tilt on the transfer roll to causes irregularities of the normal running of the mesh belt, whereby the direction in which the mesh belt is run is meandered, or the end portion of the mesh belt was turned up.

The present inventor found out that a relatively light pulp fibers, or chemical fibers are used in short fibers for the material of the water absorbing body, in a case where the causes for the scattering of the power material were further investigated. In addition, it was found out that, in the mesh belt at present constituted by plastic resin warps and plastic resin wefts, a static electricity was generated between the yarns constituting such a fabric and the short fibers. More specifically, the powder material was scattered due to the static electricity generated on the mesh belt, so that the conventional technical problems have arisen doe to such the scattered powder material.

For instance, the material of the water absorbing body of the diaper is normally constituted mainly by the pulp fibers and high molecule absorbing polymers. Such high molecule absorbing polymers are neither used in the normal water-absorbing paper, nor in the normal non-woven fabric. The present inventor assumed that high molecule absorbing polymers which is a material for the water absorbing body bears a negative charge, while that the pulp fibers bear the positive charge. Such being the case, since the mesh belt formed by the plastic wires made of the conventional resin, etc. or the metal tends to bear the negative charge due to the excessive electrons on the surface of the fabric, the above-described high molecule absorbing polymers and the pulp fibers repulse with each other, so that the powder material for the water absorbing body was caused to scatter. In an actual process for producing the water absorbing body, the mesh belt and the powder material for the water absorbing body do not contact directly, it was found out that the static electricity born on the mesh belt directly influences on the power material to cause the scattering of the power material, since the back sheet is not made of an electrically insulating material.

In this connection, the present inventor investigated Japanese Patent Laid-open Publication No. 2008-511766 disclosing the technique concerning the prevention of the electrically charging used in the producing of the non-woven fabric. In the Japanese Patent Laid-open Publication No. 2008-511766, the technique in which a structure made of an electrically conductive material is laminated on the lower surface of the mesh belt. However, since the different structure and material are laminated in this technique, the desired rigidity and the desired dehydration property for the mesh belt are not fulfilled.

In addition, Japanese Patent No. 4257291 discloses a fabric in which flat longitudinal yarns with an electrically conductive material are used. However, since this technique is preferably applied to a fabric used in an air blown part, no attention was paid to the dehydration, the surface smoothness of the fibers, fiber supportability, the improvement of the yield of the powder material, the dimensional stability, the running stability, etc., so that the desired properties required for the mesh belt are not attained.

SUMMARY OF THE INVENTION

The present invention relates to a mesh belt including warps and wefts that are woven with the warps, wherein a first yarn of the warps or the wefts on a transporting surface side of the mesh belt is made of an electrically conductive material. A second yarn of the warps or the wefts on the transporting surface side may be made of a material other than the electrically conductive material. All of the warps on the transporting surface side may be the second yarns and at least one of the wefts on the transporting surface side may be the first yarn. A member constituting a side end portion of the mesh belt may be made of an electrically conductive material.

A mesh belt used in a process for producing a water absorbing body which is formed by warps and wefts being woven with each other, one or more yarns which constitutes the warps and/or the wefts emerging on at least a transporting surface side of the mesh belt is made of an electrically conductive material.

Here, with respect to the electrically conductive material for the present invention, metal or graphite with an excellent conductivity may be uniformly dispersed into a synthetic fiber, the surface of the metal fiber which is made by metal such as stainless being fiberized, or the one of the organic fiber may be coated with metal, or the surface of the organic fiber may be coated with resin containing the electrically conductive material. For instance, the carbon fiber, metal fiber such as stainless fiber, copper and amorphous alloy, conductive synthetic fiber the surface of which is coated with a conductive polymer, or copper sulfide, or the metal dyeing fiber may be adopted.

BRIEF EXPLANATION OF DRAWINGS

FIGURE is a conceptual view showing an apparatus for producing a diaper according to the embodiment 4 of the present invention.

DETAILED DESCRIPTION OF THE INVENTION

In the present invention, at least one of the warps or the wefts constituting the fabric may be made of an electrically conductive material. In addition, all of the warps constituting the fabric may be made of an electrically conductive material, or all of the wefts constituting the fabric may be made of an electrically conductive material. Further, a plurality of the warps and the wefts may be made of an electrically conductive material.

In addition, the mesh belt used in the apparatus for producing the water absorbing body of the present invention may be used in the process for producing the water absorbing body. It is normally the fabric processed in an endless type. It can be used in any process, so long as the fabric is used in the process for producing the water absorbing body. For instance, the mesh belt of the present invention can be used in the fabric for transporting, or the fabric for drying.

Still further, any layered structure in the mesh belt of the present invention can be adopted. For instance, one or two multi-layered structure of the fabric is within the scope of the present invention.

One of an aspect of the present invention, wherein one or more yarns which constitutes the wefts emerging on at least a transporting surface side of the mesh belt may be made of a material other than the electrically conductive material, while, one or more yarns which constitutes the warps emerging on at least a transporting surface side of the mesh belt is made of the electrically conductive material.

By making a portion of, or all of the warps constituting the transporting side of the fabric contacting the material of the water absorbing body, made of an electrically conductive material, the negative charge born on the surface of the fabric due to the contact, etc. can be discharged to the atmosphere from the surface of the fabric, or it can be discharged to the ground via the apparatus for producing the fabric. As a result, the repulse between the materials which bear the negative charge such as a high molecule absorbing polymer contained in the water absorbing body can be restricted.

Another aspect of the present invention, one or more yarns which constitutes the warps emerging on at least a transporting surface side of the mesh belt may be made of a material other than the electrically conductive material, while, one or more yarns which constitutes the wefts emerging on at least a transporting surface side of the mesh belt may be made of the electrically conductive material.

Still another aspect of the present invention, a member constituting the both of side end portions in the longitudinal direction in the mesh belt may be made of an electrically conductive material.

By adopting the above structure, the static electricity generated on the mesh belt can be discharged to the ground via the wefts made of the above-described electrically conductive material, while it can be discharged to atmosphere at the folding back portion of the belt via the roll, so that the negative charge on the transporting side of the fabric contacting the material of the water absorbing body can be efficiently removed.

Still another aspect of the invention, the mesh belt may be used for transporting the water absorbing body at a portion where the material for forming the water absorbing body in the apparatus for producing the water absorbing body is received and the water absorbing body is produced.

Still another aspect of the invention, the warp density WD (%), defined by the formula of:

$$WD=D\times N/25.4\times 100,$$

may be between 25% and 160%, wherein D is a diameter of a warp (mm) and N is a number of meshes per inch (the number of the warps per inch).

The warp density is the special equation which the present inventor devised in order to indicate the denseness degrees of the diameter of the warp emerging on its cross section in a case where the fabric is vertically cut along its longitudinal direction.

The diameter of the warp is the one of one single warp, the mesh is defined to be the number of the longitudinal yarns arranged within one inch. In addition, the number "25.4" in the equation is what one inch is converted into millimeters. For instance, in a case where the diameter of the warp is 0.5 mm, and the number of longitudinal yarns per inch is 50, the warp density becomes $(0.5\times 50/25.4)\times 100=98.43\%$.

The warp density for the mesh belt of the present invention is between 25% and 160%, more preferably, 60% and 150%, further more preferably, 80% and 140%.

If the warp density for the mesh belt of the present invention is below 25%, the technical problem related to the rigidity can arise. In particular, if the warp density for the mesh belt of the present invention is below 60%, there is a risk that the product life of the fabric can be shortened due to the fact that mesh end portion can be rubbed by the guide roll. The lowest value of the ideal warp density is above 80%. On the other hand, if the warp density for the mesh belt of the present invention is above 160%, air permeability can be deteriorated. In particular, if the warp density for the mesh belt of the present invention is above 150%, there is risk that it takes more time to produce the fabric. The highest value of the ideal warp density is below 140%, the technical problem of the clogging, etc. can be restricted, so that the product life can be largely prolonged, as compared with the conventional product, in case of below 140%.

Further, since the rigidity of the mesh belt can be increased by setting the warp density to be within the above numerical range, the extension of the mesh belt can be restricted, so that the slippage can be prevented.

In a case where the warp density of the present invention is 100%, the warps are closely arranged without a space between the adjacent warps. In a case where the warp density of the present invention exceeds 100%, the structure of the warps is multi-layered structure.

According to the mesh belt used in the apparatus for producing the water absorbing body of the present invention, the technical problems in the producing line of the water absorbing body were eliminated, so that the product life of the mesh belt used in the producing line of the water absorbing body was prolonged, as compared with the conventional product.

In addition, according to the mesh belt used in the apparatus for producing the water absorbing body of the present invention, the scattering of the power material upon the operation of the producing line was restricted by preventing the scattered power material from being stuck on the transfer roll, etc. to restrain the meandering of the mesh belt.

Now, one example of the embodiment of the mesh belt used in the apparatus for producing the water absorbing body according to the present invention will be described below. Since the following embodiment is a mere example of the present invention, any embodiment which is not explicitly described below can be within the scope of the present invention.

The mesh belt of this embodiment used in the apparatus for producing the water absorbing body is constituted at least by warps and the wefts being woven with each other. The mesh belt of this embodiment may be constituted by a single weaving, one and a half weaving, a double weaving, two and a half weaving, a triple weaving, three and a half weaving, etc. In addition, no particular limitation is put on the fabric structure, so that a plain weaving, or a twill weaving may be adopted. Further, no particular limitation is put on the number of the shafts.

With respect to the electrically conductive material for the present invention, metal or graphite with an excellent conductivity may be uniformly dispersed into a synthetic fiber, the surface of the metal fiber which is made by metal such as stainless being fiberized, or the one of the organic fiber may be coated with metal, or the surface of the organic fiber may be coated with resin containing the electrically conductive material. For instance, the carbon fiber, metal fiber such as stainless fiber, copper and amorphous alloy, conductive synthetic fiber the surface of which is coated with a conductive polymer, or copper sulfide, or the metal dyeing fiber may be adopted.

In particular, the carbon fiber is preferable for the electrically conductive material for the present invention. Since the flexibility can be readily added to the carbon fiber, the workability of the carbon fiber is excellent, so that the carbon fiber can be easily woven with the plastic wire or the metal wire. In addition, the electrical resistance of the carbon fiber is low, so that it is highly electrically conductive, and thus, the negative charge on the surface of the fiber can be efficiently removed. RER (a tradename used by TORAY Co., Ltd.), RET (a trade name used by TORAY Co., Ltd.), CN225 (a trade name used by SHAKESPEARE), etc. can be enumerated.

No particular limitation is imposed on a material for the yarn to be used in the warps and wefts other than the electrically conductive material in the fabric of the present invention, and such material may be selected, in accordance with the application. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

Embodiments 1 and 2 of the present invention will now be explained as follows.

Embodiment 1

The mesh belt used in the apparatus for producing the water absorbing body of the Embodiment 1 of the present invention is a fabric of a single woven type which is constituted by warps and wefts being woven with each other by means of the plain weaving.

The warps are constituted by 16 shafts under a complete structure, and two of sixteen warps are made of a carbon fiber, that is, an electrically conductive material. In addition, the fabric of this embodiment includes eight wefts under a complete structure, and two of eight wefts are made of a carbon fiber, that is, an electrically conductive material. Other warps and wefts are constituted by a mono-filament made of polyester. In the mesh belt of the Embodiment 1 of the present invention, the diameter of the warp is 0.4 mm, the number of the meshes is 61, and the warp density is 96.06%. Further, the fabric of the Embodiment 1 of the present invention is formed into an endless type as a belt for transporting the water absorbing body.

In the mesh belt used in the apparatus for producing the water absorbing body of the Embodiment 1 of the present invention, a negative charge under an electrostatic state generated due to the contact between the material can be removed, in a case where the material for the water absorbing body rested on the surface of the fabric (which is constituted by the pulp fiber and a high molecule absorbing polymer, in this embodiment) is rested on the transporting belt in the producing apparatus. In other words, in the warps contacting the water absorbing body which is made of the above-described electrically conductive material, the negative charge can be discharged to the atmosphere mainly via the folding back portion of the belt. In addition, the wefts made of the above-described electrically conductive material can be electrically discharged to the ground via the side surface portion of the producing apparatus, so that the negative charge on the side contacting the water absorbing body where the fabric is transported can be removed.

By the above mechanism, the scattering of the powder material of the water absorbing body can be prevented upon the operation of the producing line, so that the scattered powder material can be prevented from being stuck on the transfer roll, etc., and thus, the meandering of the mesh belt can be restricted.

Embodiment 2

The mesh belt used in the apparatus for producing the water absorbing body of the Embodiment 2 of the present invention is a fabric of a single woven type which is constituted by warps and wefts being woven with each other.

The warps are constituted by 16 shafts under a complete structure, and one fourth of it is woven in a twill weaving.

The warps are constituted by a mono-filament made of polypropylene. In addition, the fabric of this embodiment includes eight wefts under a complete structure, and one of eight wefts are made of a carbon fiber, that is, an electrically conductive material. Other wefts are constituted by a mono-filament made of polyester. In the mesh belt of the Embodiment 2 of the present invention, the diameter of the warp is 0.4 mm, the number of the meshes is 77, and the warp density is 121.26%. Further, the fabric of the Embodiment 2 of the present invention is formed into an endless type as a belt for transporting the water absorbing body.

In the mesh belt used in the apparatus for producing the water absorbing body of the Embodiment 2 of the present invention, a negative charge under an electrostatic state generated due to the contact between the material can be removed, in a case where the pulp fiber and a high molecule absorbing polymer rested on the surface of the fabric is used with being rested on the transporting belt in the producing apparatus. In other words, the wefts made of the above-described electrically conductive material can be electrically discharged to the ground via the side surface portion of the producing apparatus, so that the negative charge on the side contacting the water absorbing body where the fabric is transported can be removed.

By the above mechanism, the scattering of the powder material of the water absorbing body can be prevented upon the operation of the producing line, so that the scattered powder material can be prevented from being stuck on the transfer roll, etc., and thus, the meandering of the mesh belt can be restricted.

Embodiment 3

The mesh belt used in the apparatus for producing the water absorbing body of the Embodiment 3 of the present invention is a fabric of a double woven type which is constituted by warps and wefts being woven with each other by means of the plain weaving.

The warps are constituted by 16 shafts under a complete structure, and are constituted by a mono-filament made of polyester. The wefts are constituted by eight wefts on an upper surface side and four wefts on a lower surface side under a complete structure. In addition, the warps are constituted by eight warps on an upper surface side and four warps on a lower surface side under a complete structure. Further, in this embodiment, two of eight wefts on the upper surface side are made of a carbon fiber, that is, an electrically conductive material. Two of eight warps on the upper surface side are made of a carbon fiber, that is, an electrically conductive material. In the mesh belt of the Embodiment 3 of the present invention, the diameter of the warp is 0.4 mm, the number of the meshes is 62, and the warp density is 97.64%. Further, the fabric of the Embodiment 3 of the present invention is formed into an endless type as a belt for transporting the water absorbing body.

In the mesh belt used in the apparatus for producing the water absorbing body of the Embodiment 3 of the present invention, a negative charge under an electrostatic state generated due to the contact between the material can be removed, in a case where the pulp fiber and a high molecule absorbing polymer rested on the surface of the fabric is used with being rested on the transporting belt in the producing apparatus. In other words, the wefts made of the above-described electrically conductive material can be electrically discharged to the ground via the side surface portion of the producing apparatus, so that the negative charge on the side contacting the water absorbing body where the fabric is transported can be removed.

By the above mechanism, the scattering of the powder material of the water absorbing body can be prevented upon the operation of the producing line, so that the scattered powder material can be prevented from being stuck on the transfer roll, etc., and thus, the meandering of the mesh belt can be restricted.

Embodiment 4

FIGURE is a conceptual drawing showing the apparatus for producing the diaper of the Embodiment 4. The apparatus for producing the diaper of the Embodiment 4 will now be explained about, with reference to FIGURE.

As shown in FIGURE, the apparatus 70 for producing the diaper of the Embodiment 4 includes an apparatus 40 for producing the water absorbing body, a process 41 for laminating sheets, a process 42 for compressing sheets, a process 44 for cutting sheets, a process 45 for folding sheets, and a process 46 for inspecting product.

In the apparatus 40 for producing the water absorbing body, water proof sheets forming the surface of the diaper are fed between the feeding rolls 9, 10 from the apparatus 1 for unwinding water proof sheets to be rested on the mesh belt 13 in the apparatus 40 for producing the water absorbing body. Cotton-like pulp made of paper is sprayed toward the water proof sheets to be transported on the mesh belt 13 by an apparatus 2 for spraying cotton-like pulp. Further, polymer which functions to absorb urine and hardens it into jelly form is sprayed toward the water proof sheets to be transported on the mesh belt 13 by an apparatus 3 for spraying high molecule water absorbing body. In such a case, the mesh belt 13 in an endless form is rotated in the direction as shown in an arrow via the folding back roll 15, and the tension rolls 11, 12, 14.

Next, the water proof sheet on which the water absorbing body is rested is transported to the mesh belt 13' used in the process 41 for laminating sheets. More specifically, the water absorbing sheet is fed between the feeding rolls 17, 18 from the unwinding device 4 for the water absorbing sheet, and the water absorbing body is laminated so as to be sandwiched between the water proof sheet and the water absorbing sheet. Next, the surface sheet is fed between the feeding rolls 20, 21 from the unwinding device 5 for the surface sheet, and the water absorbing sheet and the surface sheet are laminated. Next, in order to form a three-dimensional gather which prevent urine which has been once absorbed from returning back, the sheet is fed between the feeding rolls 23, 24 from an apparatus for mounting the gather sheet, and the three-dimensional gather is mounted on the surface sheet. In such a case, the mesh belt is rotated in the direction as shown by an arrow via the feeding roll 16, the folding back roll 26, and tension rolls 19, 22, 25.

Next, the laminated member constituted by a plurality of sheet being laminated is transported to the mesh belt used in the process 42 for compressing sheets. The laminated member is transported between the press rolls 7, 8 and support rolls 27, 33 to be shaped into a diaper in a compressing manner. In such a case, the mesh belt 13" is rotated in the direction as shown by an arrow via the feeding roll 27, the folding back roll 33, and tension rolls 28, 29.

Next, the laminated member rested on the mesh belt 13''' is transported to the process 44 for cutting sheets including the cutting device, to be cut into a diaper one by one. Next, the cut diaper is formed into a commercial product via the process 45 for folding sheets, and the diaper as a final product is completed via the process 46 for inspecting the product through the mesh belt. In such a case, the mesh belt is rotated in the direction as shown by an arrow via the feeding roll 30, the folding back roll 34, and tension rolls 31, 32, 35.

Further, in the mesh belt 13 used in the embodiment 4, the warp is constituted by sixteen shafts under the complete structure, two of sixteen warps is made of carbon fiber which is an electrically conductive material. Further, the fabric in this embodiment includes eight wefts under the complete structure, and two of eight wefts is made of carbon fiber made of an electrically conductive material. Other warps and wefts are constituted by mono-filament made of polyester. In addition, each of the side end portions (end portions of the wefts) of the mesh belt 13 is made of carbon fiber which is an electrically conductive material, in the longitudinal direction.

What is claimed is:

1. A mesh belt comprising:

warps and wefts that are woven with the warps, wherein:

a first yarn of the warps or the wefts on a transporting surface side of the mesh belt is made of an electrically conductive material, a warp density WD, defined by a following formula:

$$WD=D\times N/25.4\times 100,$$

is between 80% and 150%, wherein D is a diameter of each of the warps (mm) and N is a number of the warps per inch, and a portion of the mesh belt is configured to contact a powder material and remove, by the electrically conductive material, a negative charge generated on the transporting surface side of the powder material.

2. The mesh belt according to claim 1, a second yarn of the warps or the wefts on the transporting surface side is made of a material other than the electrically conductive material.

3. The mesh belt according to claim 2, wherein the warps on the transporting surface side are the second yarns and at least one of the wefts on the transporting surface side is the first yarn.

4. The mesh belt according to claim 3, wherein a member constituting a side end portion of the mesh belt is made of a second electrically conductive material.

5. The mesh belt according to claim 1, the first yarn comprises a synthetic fiber in which a metal or a graphite yarn is dispersed.

6. The mesh belt according to claim 1, the first yarn includes a metal fiber.

7. The mesh belt according to claim 6, the metal fiber is one selected from stainless steel fiber, copper fiber or amorphous alloy fiber.

8. The mesh belt according to claim 1, the first yarn includes an organic fiber coated with metal.

9. The mesh belt according to claim 1, the first yarn includes an organic fiber coated with a resin containing electrically conductive material.

10. The mesh belt according to claim 1, the first yarn includes an organic fiber coated with copper sulfide.

11. The mesh belt according to claim 1, the mesh belt is in a two-layered structure comprising the transportation surface.

12. The mesh belt according to claim 1, the mesh belt is in a two-layered structure having the warp density WD that exceeds 100%.

* * * * *